US006581675B1

(12) United States Patent
Harrington

(10) Patent No.: US 6,581,675 B1
(45) Date of Patent: Jun. 24, 2003

(54) METHOD AND APPARATUS FOR CONTINUOUS CASTING OF METALS

(75) Inventor: Donald G. Harrington, Danville, CA (US)

(73) Assignee: Alcoa Inc., Alcoa Center, PA (US)

( * ) Notice: Subject to any disclaimer, the term of this patent is extended or adjusted under 35 U.S.C. 154(b) by 0 days.

(21) Appl. No.: 09/547,253

(22) Filed: Apr. 11, 2000

(51) Int. Cl.[7] ..... B22D 11/06

(52) U.S. Cl. ..... 164/481; 164/485; 164/432

(58) Field of Search ..... 164/481, 432, 164/482, 433, 485

(56) References Cited

U.S. PATENT DOCUMENTS

| | | | | |
|---|---|---|---|---|
| 2,640,235 A | | 6/1953 | Hazelett | |
| 2,857,637 A | * | 10/1958 | Winters | 164/432 |
| 2,904,860 A | | 9/1959 | Hazelett | |
| 3,036,348 A | | 2/1962 | Hazelett et al. | |
| 3,193,888 A | * | 7/1965 | Rochester | 22/57.4 |
| 3,339,625 A | * | 9/1967 | Scherrer | 164/432 |
| 3,795,269 A | | 3/1974 | Leconte et al. | 164/73 |
| 3,937,270 A | | 2/1976 | Hazelette et al. | 164/250 |
| 4,002,197 A | | 1/1977 | Hazelett et al. | 164/250 |
| 4,054,173 A | | 10/1977 | Hickman | 164/428 |
| 4,061,177 A | | 12/1977 | Sivilotti | 164/481 |
| 4,061,178 A | | 12/1977 | Sivilotti et al. | 164/87 |
| 4,193,440 A | | 3/1980 | Thorburn et al. | 164/432 |
| 4,235,646 A | | 11/1980 | Neufeld et al. | 148/2 |
| 4,238,248 A | | 12/1980 | Gyongyos et al. | 148/2 |
| 4,303,181 A | | 12/1981 | Lewis et al. | 222/591 |
| 4,582,114 A | * | 4/1986 | Saito et al. | 164/432 |
| 4,586,559 A | | 5/1986 | Govaerts et al. | 164/455 |
| 4,751,958 A | | 6/1988 | Flowers et al. | 164/473 |
| 4,793,400 A | | 12/1988 | Wood | 164/121 |
| 4,828,012 A | | 5/1989 | Honeycutt, III et al. | 164/479 |
| 4,934,443 A | | 6/1990 | Honeycutt, III et al. | 164/479 |
| 4,940,077 A | | 7/1990 | Honeycutt, III et al. | 164/463 |
| 4,955,429 A | | 9/1990 | Honeycutt, III et al. | 164/479 |
| 5,356,495 A | | 10/1994 | Wyatt-Mair et al. | 148/551 |
| 5,470,405 A | | 11/1995 | Wyatt-Mair et al. | 148/551 |
| 5,496,423 A | | 3/1996 | Wyatt-Mair et al. | 148/551 |
| 5,514,228 A | | 5/1996 | Wyatt-Mair et al. | 148/551 |
| 5,515,908 A | | 5/1996 | Harrington | 164/481 |
| 5,564,491 A | | 10/1996 | Harrington | 164/481 |
| 5,601,140 A | * | 2/1997 | Praeg | 164/503 |
| 5,616,190 A | | 4/1997 | Legresy et al. | 148/551 |
| 5,634,991 A | | 6/1997 | Kamat | 148/551 |
| 5,655,593 A | | 8/1997 | Wyatt-Mair et al. | 164/476 |
| 5,769,972 A | | 6/1998 | Sun et al. | 148/439 |
| 5,772,799 A | | 6/1998 | Sun et al. | 148/439 |
| 5,772,802 A | | 6/1998 | Sun et al. | 148/551 |
| 5,894,879 A | | 4/1999 | Wyatt-Mair et al. | 164/476 |
| 5,913,989 A | | 6/1999 | Wycliffe et al. | 148/437 |
| 5,976,279 A | | 11/1999 | Selepack et al. | 148/551 |
| 5,985,058 A | | 11/1999 | Selepack et al. | 148/551 |
| 5,993,573 A | | 11/1999 | Selepack et al. | 148/551 |
| 6,044,896 A | | 4/2000 | Harrington | 164/428 |
| 6,102,102 A | | 8/2000 | Harrington | 164/481 |

FOREIGN PATENT DOCUMENTS

| | | |
|---|---|---|
| WO | WO 95/17274 | 6/1995 |
| WO | WO 97/11205 | 3/1997 |
| WO | WO 99/10119 | 3/1999 |

* cited by examiner

*Primary Examiner*—M. Alexandra Elve
*Assistant Examiner*—Len Tran
(74) *Attorney, Agent, or Firm*—McAndrews, Held & Malloy, Ltd

(57) ABSTRACT

An apparatus and method for strip casting of metals on at least one endless belt. The apparatus employs a tapered molding section that is large at the point of molten metal entry and tapers to a smaller thickness where a pair of pinch rolls apply a compressive force that sets the final thickness of the cast strip.

18 Claims, 3 Drawing Sheets

METHOD AND APPARATUS FOR CONTINUOUS CASTING OF METALS

CROSS-REFERENCE TO RELATED APPLICATION

Not Applicable.

STATEMENT REGARDING FEDERALLY SPONSORED RESEARCH OR DEVELOPMENT

Not Applicable.

BACKGROUND OF THE INVENTION

This invention relates to a method and apparatus for the continuous casting of metals, and particularly the casting of metal strip. The continuous casting of thin metal strip has been employed with increasing success. The conventional twin-belt caster is employed to cast in widths up to 80 inches, but typically 0.75 inch thick, requiring three in-line rolling mill stands to produce coils with strip 0.1 inches thick.

In heat sink thin strip casters, such as disclosed in U.S. Pat. Nos. 5,564,491, 5,515,908, and 6,044,896 and World Patents WO 09517274A1 and WO 9714520A, also using twin-belts, the thickness cast is typically 0.1 inch. The ability to cast wider than 20 inches with this technology, however, is unproven. In the prior art heat sink belt casters, the molten metal is fed to the curved portion of the belts on the entry pulleys, and solidification of the metal is complete by the nip of the belts on the entry pulleys. The gap between entry pulleys is adjusted to create sufficient force to cause some elongation of the strip. In adjusting the gap force, using the apparatus described in U.S. Pat. No. 6,044,896, the horizontal distance to the nozzle tip from the top pulley is adjusted at the same time as the vertical distance between top and bottom pulleys. The belts are cooled in the return loop where the belts are not in contact with molten or solid strip. The cast gauge, about 0.1 inch, is the same as that obtained with conventional twin-belt casters after three rolling passes. In the prior art heat sink casters, side dams are located before the nip of the entry pulleys by means of a combination of stationary mechanical and electromagnetic edge dams. One example of such edge dams is shown in World Patent , WO 98/36861. The solidification rate is semi-rapid, which is a metallurgical advantage for many products, but unsuitable for making can body stock requiring galling resistance. Typically, with prior art heat sink belt caster operations, after three rolling mill stands the strip thickness is down to 0.01 inch.

In conventional twin-belt strip casting equipment, two moving belts are provided which define between them a moving mold for the metal to be cast. Revolving mechanical side dam blocks fill the gap between the belts in the molding section, which necessitates that the belts be parallel in the molding section. Such parallel belts mandate that the thickness of the cast product will be nearly the same as the height of the tip delivering molten metal. Cooling of the belts is typically effected by contacting a cooling fluid with the side of the belt opposite the side in contact with the molten metal. As a result, the belt is subjected to extremely high thermal gradients, with solidifying metal in contact with the belt on one side and a water coolant in contact with the belt on the other side. The dynamically unstable thermal gradients cause distortion in the belt, and consequently neither the upper nor the lower belt is flat without adding various devices to prevent areas of segregation and porosity. The belts are more prone to distortion when the machine is wider.

Various improvements have been proposed in the prior art, including preheating of the belts as described in U.S. Pat. Nos. 3,937,270 and 4,002,197, continuously applied and removed parting layers as described in U.S. Pat. No. 3,795,269, moving endless side dams as described in U.S. Pat. No. 4,586,559 and improved belt cooling as described in U.S. Pat. Nos. 4,061,177, 4,061,178 and 4,193,440. These various improvements and others have helped the quality of the cast surface, but the cast thickness is too large to achieve important economies in the downstream rolling. Furthermore, good surface quality is more difficult to achieve as the width is increased.

Another continuous casting process that has been proposed in the prior art is that known as block casting. In that technique, a number of chilling blocks is mounted adjacent to each other on a pair of opposing tracks. Each set of chilling blocks rotates in the opposite direction to form therebetween a casting cavity into which a molten metal such as an aluminum alloy is introduced. The liquid metal in contact with the chilling blocks is cooled and solidified by the heat capacity of the chilling blocks themselves. Block casting thus differs both in concept and in execution from continuous belt casting. Block casting depends on the heat transfer, which can be effected by the chilling blocks. Thus, heat is transferred from the molten metal to the chilling blocks in the casting section of the equipment and then extracted on the return loop. Block casters thus require precise dimensional control to prevent flash (i.e. transverse metal fins) caused by small gaps between the blocks. Such flash causes sliver defects when the strip is hot rolled. As a result, good surface quality is difficult to maintain. Examples of such block casting processes are set forth in U.S. Pat. Nos. 4,235,646 and 4,238,248.

Another technique, which has been proposed in continuous strip casting, is the single drum caster. In single drum casters, a supply of molten metal is delivered to the surface of a rotating drum, which is internally water cooled, and the molten metal is dragged onto the surface of the drum to form a thin strip of metal which is cooled on contact with the surface of the drum. The strip is frequently too thin for many applications, and the free surface has poor quality by reason of slow cooling and micro-shrinkage cracks. Various improvements in such drum casters have been proposed. For example, U.S. Pat. Nos. 4,793,400 and 4,945,974 suggest grooving of the drums to improve surface quality; U.S. Pat. No. 4,934,443 recommends a metal oxide on the drum surface to improve surface quality. Various other techniques are proposed in U.S. Pat. Nos. 4,979,557, 4,828,012, 4,940,077 and 4,955,429.

Another approach, which has been employed in the prior art, has been the use of twin drum casters, such as in U.S. Pat. Nos. 3,790,216, 4,054,173, 4,303,181, or 4,751,958. Such devices include a source of molten metal supplied to the space between a pair of counter-rotating, internally cooled drums. The twin drum casting approach differs from the other techniques described above in that the drums exert a compressive force on the solidified metal, and thus effect hot reduction of the alloy immediately after freezing. While twin drum casters have enjoyed the greatest extent of commercial utilization, they nonetheless suffer from serious disadvantages, not the least of which is an output typically ranging about 10% of that achieved in the prior art devices described above. Once again, the twin drum casting approach, while providing acceptable surface quality in the casting of high purity aluminum (e.g. foil), suffers from poor surface quality when used in the casting of aluminum with high alloy content and wide freezing range. Another problem encountered in the use of twin drum casters is centerline segregation of the alloy due to deformation during solidification. These machines have demonstrated the ability to make wide product, but the production rate is typically only 10% per unit of width of heat sink and conventional belt casters.

There is thus a need to provide an apparatus and method for continuously casting metallic strip at high speeds, thin thickness and wide widths as compared to methods currently employed.

It is accordingly an object of the present invention to provide an apparatus and method for continuously casting thin metallic strip (i.e. 0.1 inch thick) using conventional wide twin-belt casters that apply coolant to at least one belt in the molding section.

Another objective of the invention is to provide an apparatus and method for the continuous casting of thin metallic strip which permit the production of wide strip (i.e. up to 80 inches) on heat sink belt casters, while retaining the high speed and thin thickness, with no cooling applied in the molding section.

Another specific objective is to provide, in one machine, a range of solidification rates for different product requirements, including a slow rate for can body stock to provide galling resistance.

These and other objects and advantages of the invention appear more fully hereinafter from a detailed description of the invention.

SUMMARY OF THE INVENTION

The concepts of the present invention reside in a method and apparatus for continuous strip casting of metals utilizing a twin-belt strip casting approach in which the molding section between the belts is large at the point of molten metal entry and tapers to a smaller thickness part way through the length of the machine where a pair of pinch rolls sets the final thickness near the end of the molten metal sump. The pinch roll gap, pinch roll-separating force, and caster speed are regulated to provide the desired strip thickness. The pinch force serves to reduce cracking and to control the strip thickness profile across the width, which is critical for successful downstream rolling.

In the present invention, the molten metal is preferably applied to the belts after the nip of the entry pulleys. Because the belts converge toward one another in the molding section, conventional tip designs, which are thick, can be utilized for feeding molten metal into the machine, while making thin strip. Solidification takes place in the tapered molding section with the belts converging toward each other by means of a pair of pinch rolls located between the tip of the casting nozzle and the exit pulleys. The strip is solidified in the molding section, which extends from the molten metal entry point to the pinch rolls. There is a strip conveyance section extending from the pinch rolls to the exit pulleys.

In the preferred embodiment of the present invention, the heat sink capacity of the belts is used for solidifying the molten metal in the molding section, and the belts are cooled in the return loop where no solidification is occurring. In that way, the method and apparatus of the present invention minimize or avoid the erratic distortion effects caused by high non-uniform thermal gradients across twin-belt strip casters of the prior art. However, the tapering of the molding section does not preclude the use of applying cooling means on the opposite side of the belts in the molding section to make thicker product, if desired.

In the present invention, the containment of molten metal on the tapered edges, after the casting nozzle tip, can be accomplished by electromagnetic means. Alternatively, edge containment can be accomplished by mechanical edge dam blocks moving with the belts and sealing on the top of the bottom belts and the side edges of the top belts.

The belts utilized in the present invention can be provided with different coatings having different thermal resistances in order to provide rapid or slow solidification and short or long solidification lengths. Thus, by varying the coatings on the belts, the metallurgical structure can be varied depending on the needs of the product. For, example, slow solidification is desirable for making can body stock with good galling resistance.

The concepts of the present invention can be employed in the strip casting of most metals, including steel, copper, zinc and lead, but are particularly well suited to the casting of thin aluminum alloy strip, while overcoming the problems of the prior art.

DETAILED DESCRIPTION OF THE INVENTION

Figure 1:
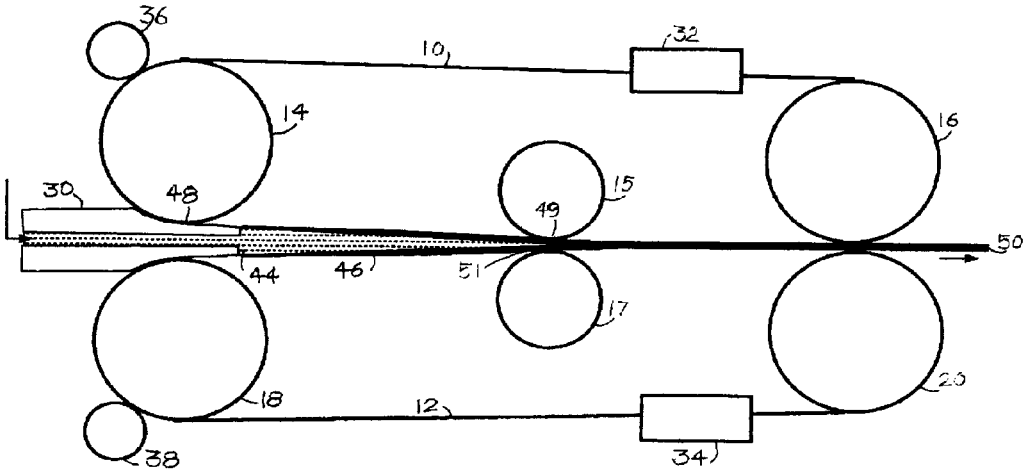
FIG. 1 is a schematic illustration of the casting method and apparatus embodying the present invention.
Figure 2:
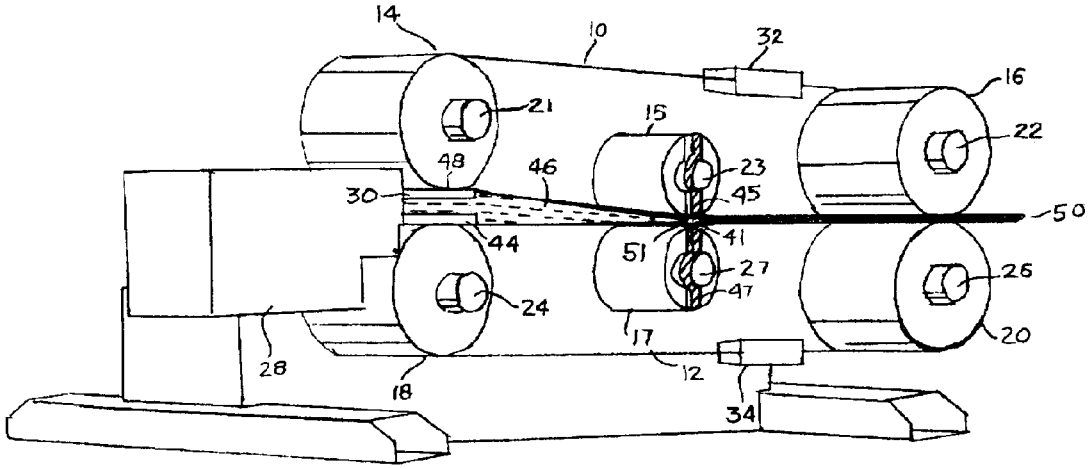
FIG. 2 is a perspective view of one casting apparatus embodying the invention.
Figure 3:
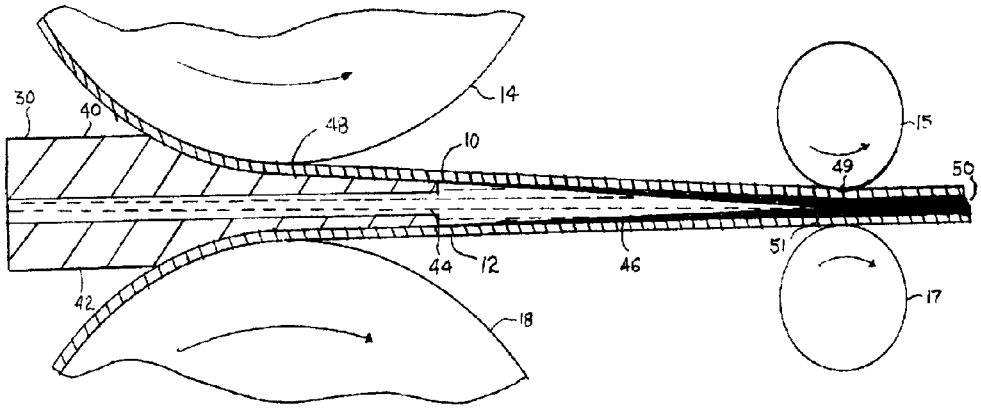
FIG. 3 is a cross-sectional view of the entry of molten metal to the apparatus and the pinch rolls illustrated in FIGS. 1 and 2.

The apparatus employed in the practice of the present invention is perhaps best illustrated in FIGS. 1, 2 and 3 of the drawings. As there shown, the apparatus includes a pair of endless belts 10 and 12 carried by a pair of upper pulleys 14 and 16 and a pair of corresponding lower pulleys 18 and 20 of FIG. 1. Each pulley is mounted for rotation about an axis 21, 22, 24, and 26 respectively of FIG. 2. The pulleys are of a suitable heat resistant type, and either or both of the upper pulleys 14 and 16 is driven by a suitable motor means not illustrated in the drawing, for purposes of simplicity. The same is equally true for the lower pulleys 18 and 20. Each of the endless belts 10 and 12 is preferably formed of a metal which has a surface that has a low reactivity or is non-reactive with the metal being cast. Quite a number of suitable metal alloys may be employed as well known by those skilled in the art. For example, steel and copper alloy belts can be employed in the apparatus.

The belts 10 and 12 define between them a molding zone which extends from the entry pulleys 14 and 18 to the nip of a pair of pinch rolls 15 and 17. As illustrated in FIGS. 1 and 2, the pinch rolls 15 and 17 are located between the entry pulleys 14, 18 and the exit pulleys 16, 20. The pinch rolls 15 and 17 are preferably movable so that the length of the molding zone may be adjusted from 5 inches to 120 inches, or more, according to the needs of a particular cast. These needs include consideration of speed, belt coatings, and product solidification rate. In the preferred practice of the invention, the gap between the pinch rolls 15 and 17, less the thickness of the two belts, is dimensioned to correspond to the desired thickness of the metal being cast. Thus, the thickness of the metal strip being cast is determined by the dimensions of the nip between belts 10 and 12 passing over pinch rolls 15 and 17 along a line passing through the axis of pinch rolls 15 and 17 which is perpendicular to the belts 10 and 12. As is described in the earlier issued U.S. Pat. No. 5,515,908, the thickness of the strip being cast is also limited by the heat capacity of the belts between which the molding takes place.

In accordance with the practice of this invention, there is provided means associated with the pinch rolls 15 and 17 to prevent displacement of the pinch rolls relative to each other. Any suitable apparatus to rigidly fix the relative positions of pinch rolls 15 and 17 may be used. FIGS. 1 and 2 illustrate a simple mechanism including pillow blocks 45 and 47 mounted on the axes 23 and 27 of the pinch rolls 15 and 17, respectively, and secured to each other by means of a tension member 41. The tension member may be either fixed or adjustable. Good results can be obtained by simply using a turnbuckle 41 as the tension member to prevent relative displacement of axes 23 and 27 relative to each other. As will be appreciated by those skilled in the art, various other and more sophisticated tension members may likewise be used. For example, use can be made of a hydraulic cylinder as the tension member to prevent relative displacement of the axes 23 and 27 relative to each other. The use of such a hydraulic cylinder has the further advantage that it is adjustable, and thus the tension can be conveniently changed depending on the application and the metal being cast.

Molten metal to be cast is supplied to the molding zone through suitable metal supply means 28 such as a tundish. The inside of the tundish 28 corresponds in width to the width of the product to be cast, and can have a width up to the width of the narrower of the belts 10 and 12. The tundish 28 includes a metal supply delivery casting nozzle 30 to deliver a horizontal stream of molten metal to the molding zone between the belts 10 and 12. Such tundishes are conventional in strip casting. Thus, the nozzle 30, as is best shown in FIG. 3 of the drawings, defines, along with the belts 10 and 12 immediately adjacent to nozzle 30, the molding zone into which the horizontal stream of molten metal flows. Thus, the stream of molten metal flowing substantially horizontally from the nozzle fills the molding zone between each belt 10 and 12 past the nip of the pulleys 14 and 18. It begins to solidify and is substantially solidified prior to the point at which the cast strip reaches the nip of pinch rolls 15 and 17. Supplying the horizontally flowing stream of molten metal to the molding zone where it is in contact with a tapered molding section of the belts 10 and 12 passing from the nozzle tip 42 to pinch rolls 15 and 17 serves to allow a larger gap at the entry pulleys 14 and 18 than the gap between the pinch rolls 15 and 17. The gap 48 between entry pulleys 14 and 18 remains fixed to maintain a good fit with nozzle 42 while the pinch roll gap 49 is adjusted. The belt linear speed, pinch roll gap, and gap separating force are regulated so that the last point to freeze 51 is substantially at the belt nip between pinch rolls 15 and 17. The center of the strip may have a "mush" zone that is partially solidified that is capable of supporting a gap force.

The belts 10 and 12 also define between them a strip conveyance zone which extends from the pinch rolls 15 and 17 to the exit pulleys 16 and 20. The belts 10 and 12 in the conveyance zone may be parallel to each other, or alternatively may be diverging so that the gap between the exit pulleys 16 and 20 is larger than the gap between the pinch rolls 15 and 17.

In accordance with the preferred embodiment of the invention, the casting apparatus of the invention includes a pair of cooling means 32 and 34 positioned opposite that portion of the endless belt in contact with the metal being cast in the molding zone between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thickness. Alternatively, the cooling means can be located in the molding section, the conveyance section, or on the exit pulleys depending on the thickness and speed of operation. For example, thicker cast strip, 0.2 inch to 0.8 inch, might require cooling in the molding section, while retaining the pinch roll concept. It is sometimes desirable to employ scratch brushes 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of this invention, molten metal flows horizontally from the tundish through the casting nozzle 30 into the casting or molding zone defined between the belts 10 and 12 where the belts 10 and 12 are heated by heat transfer from the cast strip to the belts 10 and 12. The cast metal strip remains between and conveyed by the casting belts 10 and 12 after the pinch rolls 15 and 17 until each of them is turned past the centerline of exit pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by the scratch brushes 36 and 38 while passing over pulleys 14 and 18, they approach each other to once again define a molding zone.

The most preferred supply of molten metal from the tundish through the casting nozzle 30 is shown in greater detail in FIG. 3 of the drawings. As is shown in that figure, the casting nozzle 30 is formed of an upper wall 40 and a lower wall 42 defining a central opening 44 therebetween whose width may extend substantially over the width of the belts 10 and 12 as they pass around pulleys 14 and 18, respectively. The distal ends of the walls 40 and 42 of the casting nozzle 30 are in substantial proximity of the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12. As in prior art belt casters, the molten metal contacts the casting belts 10 and 12 after the nip 48 of the entry pulleys 14 and 18 in the linear section. In the molding zone the gap between the belts 10 and 12 is tapered from the gap between entry pulleys 14 and 18 to the gap between pinch rolls 15 and 17. Hence, in the present invention solidification is substantially complete near the nip 49 of the pinch rolls 15 and 17. The space between the belts 10 and 12 at the time that they first come into contact with the molten metal just after the nip 48 of the entry pulleys 14 and 18, is substantially larger then the gap 49 between the belts 10 and 12 at the pinch rolls 15 and 17. In this way molten metal 44 can be delivered to the molding zone 46 through a nozzle 30 which is much thicker than the thickness of the strip 50. This is an important distinction of this invention that enables thinner strip to be cast than prior art conventional twin-belt casters. In addition, because the space between the belts 10 and 12 where they first come in contact with the molten metal is much larger than the nip 49 of the pinch rolls 15 and 17, any distortion in the belts in this region has little effect on the metal being cast. The high thermal gradient largely dissipates before the belts 10 and 12 reach the pinch roll nip 49, and thus any distortions that do occur diminish as the belts approach the pinch roll nip.

The importance of freezing or solidification before the nip 49 also arises from the fact that as shown in FIG. 3 of the drawings, the metal solidifying between the tapered surfaces in the molding zone prior to the nip has a dimension or thickness greater than the corresponding dimension or thickness of the nip itself. That insures that when the solidified cast metal is advanced to the nip 49, it has a larger dimension than that of the nip, thereby insuring that the nip 49 exerts a compressive force on the cast metal strip to thereby cause elongation to improve not only surface characteristics but also to reduce the tendency of the strip to crack. It should be noted that the central core of the strip might be semi-solid and able to support some separating force. In addition, the compressive force exerted on the cast metal strip between the pinch rolls insures good thermal contact between the cast metal strip and the belts and establishes a good thickness profile needed for subsequent rolling.

The amount of compressive force is not critical to the practice of the invention. By adjusting the gap between the pinch rolls 15 and 17 and/or adjusting the machine speed, the amount of compressive force that is applied to the cast strip can be controlled. The compressive force should be sufficiently high to insure good thermal contact between the cast metal strip and the belt as well as sufficiently high so as to cause elongation. The elongation is preferably sufficient to insure that the cast metal strip, as it is exits from the nip 49 is in a state of compression as distinguished from tension. Maintaining the cast strip under compressive force serves to minimize cracking that would otherwise occur if the cast strip were maintained under tension. In general, it is desirable that the percent elongation be relatively low, generally below 10 percent, and most preferably below 5 percent.

The thickness of the strip that can be cast is, as those skilled in the art will appreciate, related to the thickness of the belts 10 and 12, the return temperature of the casting belts and the exit temperature of the strip and belts. In addition, the thickness of the strip depends also on the metal being cast. In general, aluminum strip having a thickness of 0.100 inches using steel belts having a thickness of 0.08 inches can provide a return temperature of 300 degree F. and an exit temperature of 800 degree F. The interrelationship of the exit temperature with belt and strip thickness is described in detail in application Ser. No. 07/902,997, now abandoned. For example, for casting aluminum strip for a thickness of 0.100 using a steel belt having a thickness of 0.06 inches, the exit temperature is 900 degree F. when the return temperature is 300 degree F. and the exit temperature is 960 degree F. when the return temperature is 400 degree F.

One of the advantages of the method and apparatus of the present invention is that there is now, for heat sink twin-belt casting, an option to employ a thermal barrier coating on the belts to reduce heat flow and thermal stress, as is typically employed in the prior art conventional twin-belt casting. The absence of fluid cooling on the back side of the belt while the belt is in contact with hot metal in the molding zone significantly reduces thermal gradients and eliminates problems of film boiling occurring when the critical heat flux is exceeded. The method and apparatus of the present invention also minimizes cold framing, a condition where cold belt sections exist in three locations: (1) before metal entry and (2) on each of the two sides of mold zone of the belt. Those conditions can cause severe belt distortion. In addition, there may be molding conditions that require the use of parting agents to prevent sticking of the cast metal strip to either of the belts. These agents typically add thermal resistance, which therefore requires a longer molding zone than that provided by prior art heat sink casters, such as disclosed in U.S. Pat. No. 5,564,491, where solidification begins and ends on the curve of the entry pulleys. In contrast, the longer molding zone of the present invention, which extends from the nozzle tip 44 to the nip of the pinch rollers, allows the use of such parting agents. The longer molding zone and lower heat flux values results in less belt distortion, which in turn enables casting in wider widths (i.e. up to 80 inches) while keeping the strip thin (i.e. a thickness of 0.1 inches).

For some applications, it can be desirable to employ one or more belts having longitudinal grooves on the surface of the belt in contact with the metal being cast. Such grooves have been used in single drum casters as described in U.S. Pat. No. 4,934,443 and WO 09714520A. As will be appreciated by those skilled in the art, coolant can be applied to the belts in one or more of these locations: molding zone opposite the molten metal; conveyance zone opposite solidified strip; grooves in the exit pulleys; and in the return leg between the exit and entry pulleys. In a preferred embodiment of the invention, the bottom pinch roll is set so that there is very little wrap of the bottom belt on that pinch roll and most of the gap adjustment is by movement of the top pinch roll; additionally, there is no cooling applied in the molding section on the top or bottom belts or on the top belt in the conveyance section but cooling is applied on the bottom belt in the conveyance section and the return loop of the top belt. The purpose of the forgoing arrangement is the promotion of late release of the strip from the bottom belt, by minimizing the bending of the strip at the pinch roll and thermal contraction of the bottom belt as the strip is contracting in the conveyance section. The late thermal release cools the strip to a lower temperature where it is stronger and less brittle.

Figure 4:
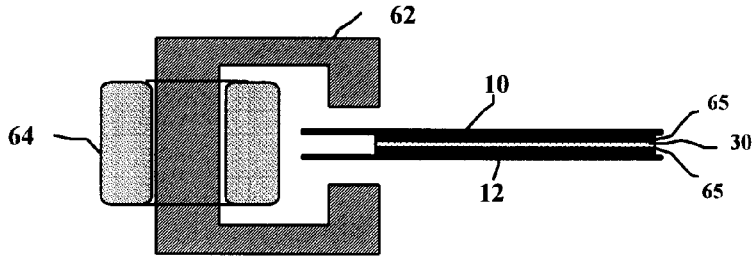
FIG. 4 is a cross-sectional view of an electromagnetic edge dam that can be utilized in the apparatus shown in FIGS. 1 and 2.
Figure 5:
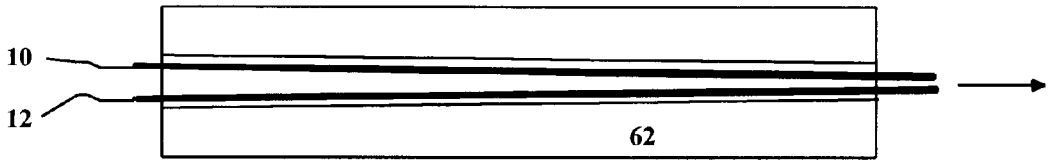
FIG. 5 is a side view of an electromagnetic edge dam and the tapered molding section formed by two belts.
Figure 6A:
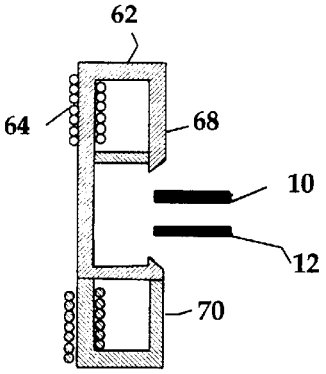
FIG. 6A is a cross section of an alternating segment electromagnetic edge dam.

Containment of molten metal at the sides of the strip in the tapered molding section is a vital feature of this invention. In one embodiment, illustrated in FIGS. 4–6, electromagnetic edge dams are utilized to contain the molten metal 30 between the solidifying metal 65 adjacent the belts 10 and 12 and prevent the molten metal from running out the edges of the belts. The electromagnetic edge dam comprises a core 62 upon which is mounted a coil 64 which produces an electromagnetic field. The edges of belts 10 and 12 run through the core 62 and the field generated by the coil 64 contains the molten metal along the edges of the belts. Electromagnetic edge dams are described in further detail in World Patent WO 98/36861 which is hereby incorporated by reference. However, because the apparatus of the present invention employs a molding zone that is longer than that provided by prior art casting equipment, electromagnetic edge dams that extend substantially the entire length of the molding zone must be utilized in the present invention.

Figure 6B:
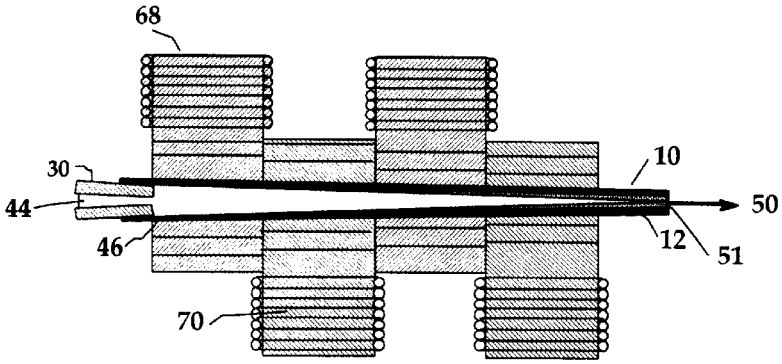
FIG. 6B is a side view of an alternating segment electromagnetic edge dam.

One way of extending the length of the electromagnetic edge dams is to use alternating upper and lower electromagnetic containment segments 68 and 70, respectively, as illustrated in FIG. 6B. Each segment butts an adjacent segment and the location of the coils 64 alternates between adjacent segments to allow room for each segment to have its own coil.

Another mechanism for containing the molten metal is to use moving edge dam blocks. Moving edge dam blocks are described, for example, in U.S. Pat. No. 3,795,269 which is hereby incorporated by reference in its entirety. Such edge dam blocks must be modified, however, to accommodate the tapered molding zone of the present invention.

Figure 7:
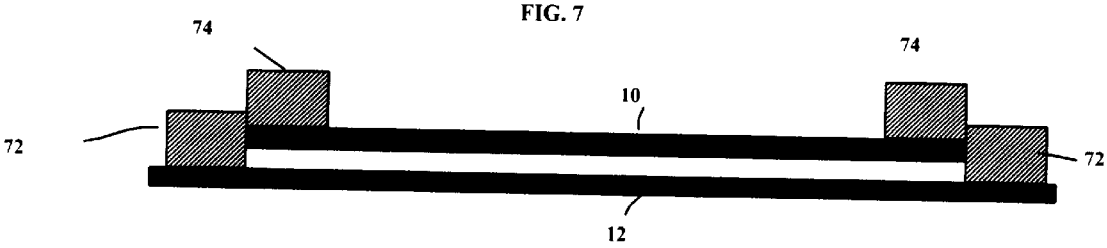
FIG. 7 is an end cross-section view of moving side dam blocks that can be utilized in the apparatus shown in FIGS. 1 and 2.

Referring to FIG. 7, the top belt 10 is narrower than the bottom belt 12 so that the edge dam block 72 rides on the top of the bottom belt 12 and seals on the sides of the top belt 10. An optional second set of edge dam blocks 74 can ride on the top belt 10 to further prevent the molten metal from running over the edges of the belts.

What is claimed is:

1. Apparatus for casting molten metal into a metal strip by continuous belt casting comprising:

(a) a pair of moving continuous belts formed of heat conductive material, each of the belts being mounted on pulleys, including an entry pulley and an exit pulley, so that each belt passes around the entry pulley and defines a curved surface about the entry pulley, and a substantially linear surface after the belt passes around the entry pulley, the entry pulleys being mounted one above the other so that the belts, as they pass around the entry pulleys, define a gap of fixed dimension;

(b) means including a nozzle for delivering molten metal to the linear surfaces of the belts, the nozzle having a tip extending to both belts and positioned after the gap at the entry pulleys;

(c) a pair of pinch rolls disposed between the entry and exit pulleys adjacent the linear surface of the belts, the pinch rolls being positioned one above the other, with the belts passing over the pinch rolls and defining a nip therebetween, said nip lying in a plane defined by the axes of the pinch rolls, the nip having a gap that is smaller than the gap at the entry pulleys so that the linear surfaces of the belts converge toward each other forming a tapered molding zone therebetween, the molding zone extending between the nozzle and the pinch roll nip so that the last point of the molten metal to freeze is near the pinch roll nip and the metal strip is substantially solidified at the pinch roll nip;

(d) edge containment means for preventing flow of molten metal beyond the edge of the converging belts in the molding zone, the edge containment means operating to accommodate a progressively smaller distance between the edges of the belts that occurs as a result of the linear surfaces of the belts converging toward each other in the tapered molding zone; and (e) means associated with the pinch rolls to control the spacing therebetween so that the substantially solidified metal strip has a thickness that is greater than the nip between the pinch rolls and the nip thereby provides a compressive force on the substantially solidified cast strip effective to elongate the cast strip to minimize cracking.

2. Apparatus as defined in claim 1 that includes means for advancing each of said belts about the pulleys.

3. Apparatus as defined in claim 1 that includes cooling means positioned adjacent to each of said belts.

4. Apparatus as defined in claim 3 which includes cooling means positioned adjacent to each of said belts when said belts are not in contact with either the molten metal or the cast metal, said cooling means serving to reduce the temperature of the belts by removing, when the belts are not in contact with either the molten metal or the cast strip, substantially all of the heat transferred by the molten metal and the cast metal to the belts.

5. Apparatus as defined claim 1 wherein the edge containment means comprises electromagnetic edge dams.

6. Apparatus as defined in claim 1 wherein the belts are positioned one above the other with one belt constituting a top belt and the other belt constituting a bottom belt, the top belt being narrower in width than the bottom belt, and the edge containment means comprises moving edge dam blocks that ride on top of the bottom belt edges and seal on the sides of the top belt to prevent leaking molten metal as said belts converge in the molding zone.

7. Apparatus as defined in claim 1 wherein the means for supplying the molten metal includes a tundish.

8. Apparatus as defined in claim 1 wherein the molding zone has a length that extends from the entry pulleys to the pinch roll nip and the pinch rolls are longitudinally movable to adjust the length of the molding zone.

9. Apparatus as defined in claim 8 wherein the length of the molding zone can be adjusted from five inches to 120 inches.

10. Apparatus for casting metal strip by continuous belt casting comprising:

(a) a pair of continuous belts formed of a heat conductive material mounted one above the other;

(b) a pair of at least two pulleys including an entry pulley and an exit pulley, each of said belts being mounted on one entry pulley and one exit pulley and passing around the entry pulley whereby the belts define a curved surface about said entry pulley and a substantially linear surface after the belt passes around the entry pulley, the entry pulleys being mounted one above the other so that the belts, as they pass around the entry pulleys, define a gap of fixed dimension;

(c) a pair of pinch rolls located between the entry pulleys and the exit pulleys adjacent the linear surface of the belts, the pinch rolls being positioned one above the other and having a gap therebetween, with the belts passing over the pinch rolls and defining a pinch roll nip therebetween, said nip lying in a plane defined by the axes of the pinch rolls, the nip having a gap that is smaller than the gap at the entry pulleys so that the linear surfaces of the belts converge toward each other and form a tapered molding zone therebetween;

(d) nozzle means for supplying a molten metal to the linear surface of each belt, and the nozzle means having a tip extending to both belts and positioned after the gap at the entry pulleys, wherein the tip, along with the linear surfaces of the belts and the pinch roll nip define the tapered molding zone so that the last point of the molten metal to freeze is near the pinch roll nip and the metal strip is substantially solidified at the pinch roll nip;

(e) edge containment means for preventing flow of molten metal beyond the edge of the converging belts in the molding zone, the edge containment means operating to accommodate a progressively smaller distance between the edges of the belts that occurs as a result of the linear surfaces of the belts converging toward each other in the tapered molding zone; and (f) means associated with the pinch rolls to control the spacing therebetween so that the substantially solidified cast metal strip has a thickness that is greater than the nip between the pinch rolls, and the nip thereby provides a compressive force on the substantially solidified cast strip at the pinch roll nip sufficient to cause the cast strip to have a thickness profile that substantially matches the gap of the pinch rolls.

11. Apparatus as defined in claim 10 which includes cooling means positioned adjacent to the belts.

12. Apparatus as defined in claim 10 which includes tension means connected to the axis of each pinch roll to prevent displacement of the pinch rolls away from each other.

13. A method for casting of metals by continuous belt casting comprising the steps of:

(a) introducing molten metal with a nozzle between a pair of belts formed of a heat conductive material, each belt moving around pulleys, including an entry pulley and an exit pulley, wherein said nozzle having a tip extending to both belts and positioned after the gap of entry pulleys, a pair of pinch rolls disposed between the entry pulleys and the exit pulleys, the pinch rolls defining a nip therebetween, with the nip lying in a plane defined by the axes of the pinch rolls substantially perpendicular to the belts, each belt passing around the entry pulley defines a curved surface about the entry pulley and a substantially linear surface after the belt passes around the entry pulley, the substantially linear surfaces converging toward each other as they pass from the entry pulleys to the pinch rolls to define a tapered molding zone therebetween;

(b) regulating the speed of the moving belts and the gap between the pinch rolls at the nip thereof so that the last point of the molten metal to freeze is near the pinch roll nip and solidification of the molten metal is substantially complete in the tapered molding zone to form a strip of cast metal having a thickness greater than the thickness of the pinch roll nip; and (c) advancing the cast strip to the pinch roll nip to effect a compressive force on the substantially solidified cast strip at the nip sufficient to cause elongation thereof so that the cast strip is in compression in the direction of travel after exiting from the pinch roll nip to minimize cracking of the cast strip.

14. A method as defined in claim 13 wherein the molten metal is supplied in a substantially horizontal stream to the molding zone.

15. A method as defined in claim 13 wherein said metal is an aluminum alloy.

16. A method as defined in claim 13 which includes the step of cooling the belt to remove the heat transferred to the belt from the molten metal and cast metal.

17. A method as defined in claim 13 wherein the compressive force is sufficient to effect less than 15% elongation of the cast strip.

18. A method for casting of metals by continuous belt casting comprising the steps of:

(a) introducing molten metal with a nozzle between a pair of casting belts formed of heat conductive metal, each of said belts moving around pulleys, including an entry pulley and an exit pulley, wherein said nozzle having a tip extending to both belts and positioned after the gap of the entry pulleys, a pair of pinch rolls disposed between the entry pulleys and exit pulleys, the pinch rolls defining a nip therebetween, with the nip lying in a plane defined by the axes of the pinch rolls substantially perpendicular to the belts the belts defining a molding zone therebetween and each belt, as it passes from the entry pulleys to the pinch rolls, defines a linear tapered molding zone surface;

(b) regulating the speed of the moving belts and the gap between the pinch rolls at the nip thereof so that the last point of the molten metal to freeze is near the pinch roll nip and solidification of the molten metal is substantially complete at the pinch roll nip to form a strip of cast metal having a thickness greater than the gap between belts at the pinch roll nip;

(c) advancing the cast strip to the pinch roll nip to effect a compressive force on the substantially solidified cast strip at the nip sufficient to cause elongation thereof so that the cast strip is in compression in the direction of travel after exiting from the nip to minimize cracking of the cast strip; and (d) cooling each of the belts to substantially remove the heat transferred to the belt from the molten metal and the cast strips.

* * * * *